US006418903B2

(12) United States Patent
Müller et al.

(10) Patent No.: US 6,418,903 B2
(45) Date of Patent: Jul. 16, 2002

(54) CONNECTION OF A CRANKCASE OF A RECIPROCATING-PISTON INTERNAL COMBUSTION ENGINE WITH A CYLINDER HOUSING

(75) Inventors: Wolfgang Müller; Wolfgang Weissert, both of Winnenden; Gunther Zimmermann, Waiblingen, all of (DE)

(73) Assignee: Andreas Stihl AG & Co., Wailblingen (DE)

( * ) Notice: Subject to any disclaimer, the term of this patent is extended or adjusted under 35 U.S.C. 154(b) by 0 days.

(21) Appl. No.: 09/730,555

(22) Filed: Dec. 7, 2000

(30) Foreign Application Priority Data

Dec. 7, 1999 (DE) ..... 199 58 828

(51) Int. Cl.[7] ..... F02F 7/00
(52) U.S. Cl. ..... 123/195 R; 277/606
(58) Field of Search ..... 123/195 R; 277/591–606

(56) References Cited

U.S. PATENT DOCUMENTS 4,280,453 A * 7/1981 List et al. ..... 123/195 A
4,294,203 A * 10/1981 Jones ..... 123/195 R
4,825,820 A * 5/1989 Morgan ..... 123/197.4
5,456,229 A * 10/1995 Emmerich ..... 123/195 R
6,053,142 A * 4/2000 Achenbach et al. .... 123/195 C
6,192,840 B1 * 2/2001 Durr et al. ..... 123/41.65

FOREIGN PATENT DOCUMENTS

DE 3018014 11/1981
DE 3613754 10/1986

* cited by examiner

*Primary Examiner*—Tony M. Argenbright
*Assistant Examiner*—Katrina B. Harris
(74) *Attorney, Agent, or Firm*—Walter Ottesen

(57) ABSTRACT

The invention relates to a connection of a crankcase (3) of an internal combustion engine (1) to a cylinder housing (2) of which at least one housing part is made of light metal. The housing parts (2, 3) lie with their respective housing flanges (4, 5) in surface contact one against the other and are clamped seal-tight to each other with the aid of retaining screws (7). The retaining screws (7) are of light metal and a curing liquid seal (18) is between the housing flanges (4, 5) so as to lie against both sides. In this way, a connection for a light metal cylinder housing (2) with a crankcase (3) is achieved by using light metal housing materials. A reliable seal is provided which is permanently resistant to the operating loads of the engine (1).

12 Claims, 2 Drawing Sheets

Fig. 2
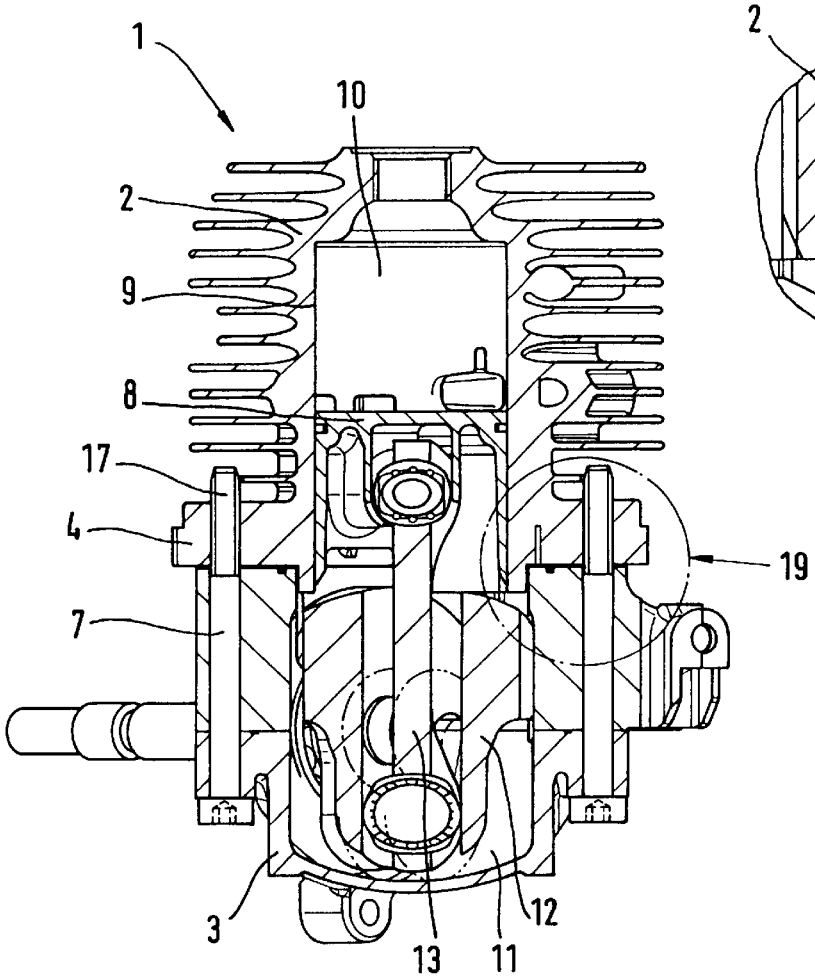
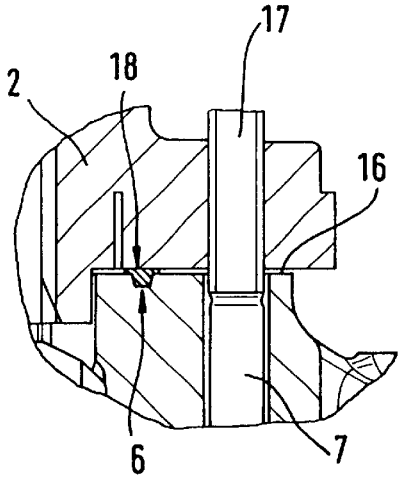
Fig. 3

CONNECTION OF A CRANKCASE OF A RECIPROCATING-PISTON INTERNAL COMBUSTION ENGINE WITH A CYLINDER HOUSING

FIELD OF THE INVENTION

The invention relates to the connection of a crankcase of a reciprocating-piston internal combustion engine to a cylinder housing wherein at least one of the housing parts is made of a light metal material.

BACKGROUND OF THE INVENTION

In the cylinder housing of an internal combustion engine, the reciprocating piston is guided so as to be longitudinally movable and the combustion chamber is configured wherein the working process of the engine takes place. The longitudinal movement of the reciprocating piston is converted, as known, into a rotary movement in a crank drive. The components of the crank drive are essentially the crankshaft and the piston rod via which the piston is operatively connected to the crankshaft and these components are accommodated in the crankcase of the engine. In the assembly of an engine, the components of the crank drive are seated in the crankcase and, thereafter, the cylinder housing is connected to the crankcase. The cylinder housing and the crankcase have respective housing flanges which lie one against the other and are clamped to each other seal-tight by means of retaining screws. The tension force in the retaining screws must be high enough in order to hold the connection seal-tight and to prevent an escape, for example, of lubricating oil from the interior of the engine.

In modern internal combustion engines, the housing is often manufactured from a light metal material in order to hold the weight of the engine as low as possible. This is especially so for internal combustion engines for handheld portable work apparatus which should perforce be as light as possible. For this reason, cylinder housings made of light metal, such as aluminum, are utilized. In known crankcase/cylinder housing connections, retaining screws made of steel are used in order to press the housing flanges together with sufficient force and to so achieve a sealing of the connection. Often, a sealing insert is provided in addition for the sealing and this sealing insert makes a still higher tension force of the screw connection necessary which the steel screws can provide. Usually, several retaining screws are arranged along the housing flange around the housing parts.

However, in the operation of internal combustion engines, fractures of the housing part made of light metal in the region of the retaining screws occur again and again with advanced operating times. The fractures are caused by excessive tensile stresses in the area of the retaining screws which are caused by uneven higher thermal expansion of the light metal compared to the material of the retaining screws.

An attachment of a component, which exhibits a high thermal expansion, to a component which exhibits a lesser thermal expansion, is known from German patent publication 3,018,014. Here, the component having the higher thermal expansion is connected to the component having lesser thermal expansion by interposing a spring. The spring can be stressed via a screw connection and this screw connection passes through the component having the higher thermal expansion with radial spacing.

Furthermore, a connecting configuration between two components having different coefficients of thermal expansion is known from German patent publication 3,613,754. The surface of one component, which lies opposite the other component, is covered with a layer of coating material and a seal is inserted between the coating material of the one component and the other component. The coating material should have an adhesive action. With increasing temperature, the adhesive force with respect to the seal increases from a value less than the holding force of the other component with respect to the seal to a value greater than this holding force. For this purpose, a binding layer is arranged between the seal and the directly bordering surface of the second component and this binding layer imparts a greater adhesion to the seal relative to the second component than relative to the coating material.

In the known connections for components having different thermal expansion, the connecting screws, however, do not provide for an adequate surface pressing between the flanges which is necessary for the seal of the connection of a crankcase of an engine to a cylinder housing.

SUMMARY OF THE INVENTION

It is an object of the invention to provide a connection for a cylinder housing having a crankcase and of which at least one housing part is made of light metal. It is a further object of the invention to provide such a connection which permanently withstands the operating loads of the engine and provides a reliable seal.

The connection of the invention is for a crankcase housing of a reciprocating-piston internal combustion engine with a cylinder housing and includes: first and second housing flanges formed on the crankcase housing and the cylinder housing, respectively; the crankcase housing and the cylinder housing being positioned so as to cause the first and second flanges to lie one atop the other thereby conjointly defining an interface; at least one of the crankcase housing and the cylinder housing being made of a light metal; a cured liquid seal disposed between the flanges at the interface; and, a plurality of retaining screws made of light metal and being arranged so as to tightly clamp the flanges together.

According to the invention, retaining screws of light metal are provided which expand substantially more uniformly with the light metal of the housing than steel retaining screws with warming during operation of the engine. The tensile strength of the retaining screws used in accordance with the invention is nominally less than with conventionally used steel screws but an increase of the shank cross section of the light metal screws compared to the shank cross section of a steel screw of comparable tensile strength is unnecessary because of the arrangement according to the invention of a curing liquid seal between the housing flanges. The liquid seal can already, even for lesser tension forces, hold the gap seal-tight between the housing flanges. A reliable connection with simple and cost-effective means is achieved with the combination of light metal retaining screws with a liquid seal between the housing flanges.

The liquid seal comprises a material which can be applied to the housing flange in a liquid or soft state and cures later. The liquid seal is pressed into the sealing form in the soft state and adheres to the two housing flanges to be connected after curing and contributes to the strength of the connection. The material of the liquid seal interlaces increasingly with the curing and becomes structurally solid. Advantageously, the liquid seals are on a silicone basis or modified silicone seals.

Retaining screws are purposefully used which are made of a material having essentially the same thermal expansion characteristics as the light metal material of the housing. Retaining screws of aluminum are seen as especially advantageous. As a material "aluminum", all technical aluminum alloys are understood in this context of which also commercial aluminum screws for other fastening applications are comprised. The aluminum retaining screws are especially advantageous for threadably fastening cylinder and crankcase housings of aluminum alloy such as cylinder housings which comprise die cast aluminum. The advantages of the connection of the invention become manifest, however, also when using, for example, magnesium die cast housings.

In an advantageous further embodiment of the invention, the retaining screw includes a self-cutting thread and is screwed into a threadless bore in the component to be attached during assembly of the engine. This component is purposefully the cylinder housing made of light metal which, for assembly, is provided simply with bores for accommodating the retaining screw. Advantageously, the threaded shank of the retaining screw is provided with a coating which is harder than the material of the cylinder housing.

It is purposeful to provide one of the housing flanges with a slot in its surface which comes into contact with the housing flange of the other housing component and to fill this slot with a liquid seal. The slot runs continuously along the housing flange. The self-curing liquid seal is filled into the slot during assembly and forms similarly to a rubber sealing ring but is connected with the component so as to be inseparable with respect thereto. Such a quantity of the liquid seal is injected into the slot that the liquid seal extends over the slot edge and comes into contact with the housing flange which is to be connected. The seal is effective independently of the surface quality of the housing flange. When the connection is disconnected, for example, for the purpose of maintenance of the engine interior, a simple reassembly is possible. New sealing material is then simply filled into the slot.

BRIEF DESCRIPTION OF THE DRAWINGS

The invention will now be described with reference to the drawings wherein:

FIG. 2 is a section view of the internal combustion engine of FIG. 1; and, FIG. 3 is an enlarged view of the detail 19 of FIG. 2.

DESCRIPTION OF THE PREFERRED EMBODIMENTS OF THE INVENTION

Figure 1:
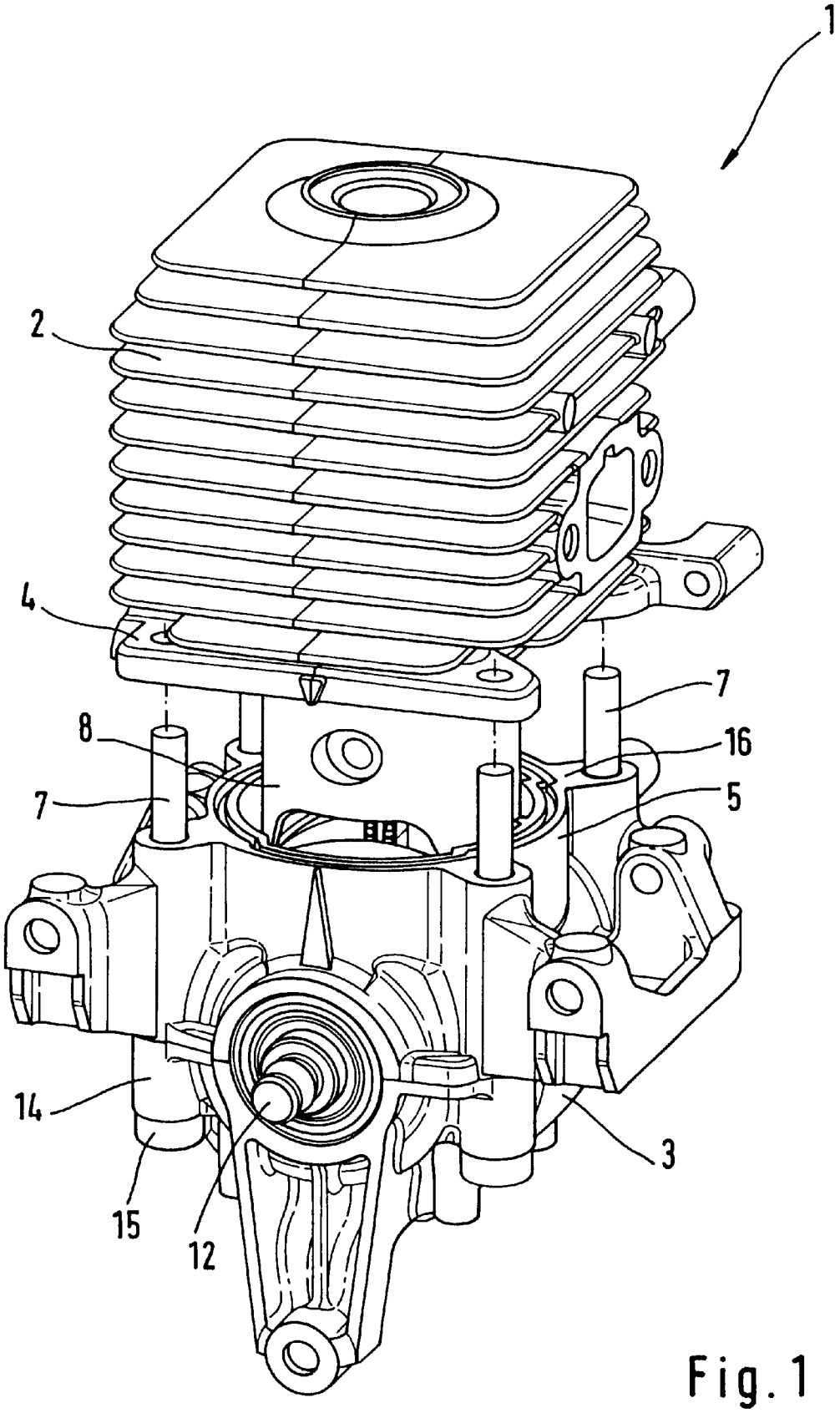
FIG. 1 is a perspective view of an internal combustion engine having a crankcase and a cylinder housing of light metal.

FIG. 1 is a perspective view of an air-cooled reciprocating piston of an internal combustion engine 1 which is provided for use in portable handheld work apparatus. The engine 1 is configured with a single cylinder and the cylinder is formed in the interior of the cylinder housing 2. A reciprocating piston 8 is guided to move longitudinally in the interior of the cylinder housing 2 along a cylinder path 9 (FIG. 2). The reciprocating piston 8 delimits a combustion chamber 10 wherein the combustion process takes place which acts on the reciprocating piston 8. The longitudinal movement of the piston 8 is translated into a rotational movement of a cropped crankshaft 12 via a connecting rod 13. The crankshaft 12 is journalled in a crankcase 3 in whose interior space 12 the cropped crank lug with the deflected connecting rod 13 rotates.

The cylinder housing 2 and the crankcase 3 are magnesium or aluminum die cast parts. The housing parts (2, 3) can also be made of another light metal which reduces the total weight of the engine 1.

In the present embodiment, the cylinder housing 2 is manufactured as an aluminum die cast part and the crankcase 3 is manufactured as a magnesium die cast part. The crankcase 3 is connected to the cylinder housing 2 by means of retaining screws 7. A housing flange 4 of the cylinder housing 2 and a housing flange 5 of the crankcase 3 lie in surface contact against each other.

In the present case, four retaining screws 7 are provided which are uniformly distributed along the periphery of the housing flanges (4, 5). The retaining screws 7 are configured as cap screws. The screw shanks are insertable into screw receptacles 14 of the crankcase 3 from the side lying opposite to the cylinder housing 2 and can be screwed with the threaded tip into the housing flange 4 of the cylinder housing 2. The screw caps 15 of the retaining screws 7 hold the crankcase tight against the cylinder housing 2 under tension.

The retaining screws 7 are comprised of aluminum or an aluminum alloy. A continuous peripherally extending slot 6 is machined into the surface 16 of the housing flange 5 of the crankcase 3 into which a liquid seal is injected before securing the cylinder housing 2 with the screws.

In the present embodiment, the slot 6 is formed in the crankcase; however, it is also possible to introduce the slot 6 into the cylinder housing 2.

In the detail view of the contact surfaces of the housing flanges shown in FIG. 3, it can be seen that the slot 6 has a cross section which widens toward the surface 16 of the flange and, in the present case, the slot has a cross section of trapezoidal shape. The slot 6 is then filled with a liquid material on a silicone basis which is injected into the slot 6 while it is soft and cures automatically. The liquid seal 18 interlaces during curing and forms a structurally tight seal in the form of an annularly extending sealing ring. The structurally tight liquid seal 18 adheres to both housing flanges lying one against the other and contributes to the strength of the connection.

The retaining screws 7 of aluminum have a self-cutting thread. In the embodiment, the threaded shanks 17 are coated with a material which is harder than the material of the cylinder housing 2. During the manufacture of the engine, bores are drilled at corresponding locations in the housing flange 4 of the cylinder housing 2 into which the threaded shaft of the retaining screws cut.

It is understood that the foregoing description is that of the preferred embodiments of the invention and that various changes and modifications may be made thereto without departing from the spirit and scope of the invention as defined in the appended claims.

What is claimed is:

1. A connection of a crankcase housing of a reciprocating-piston internal combustion engine with a cylinder housing, the connection comprising:

first and second housing flanges formed on said crankcase housing and said cylinder housing, respectively;

said crankcase housing and said cylinder housing being positioned so as to cause said first and second flanges to lie one atop the other thereby conjointly defining an interface;

at least one of said crankcase housing and said cylinder housing being made of a light metal;

a cured liquid seal disposed between said flanges at said interface; and, a plurality of retaining screws made of light metal and being arranged so as to tightly clamp said flanges together.

2. The connection of claim 1, wherein the material of said retaining screws has essentially the same thermal expansion characteristics as the light metal material of said one housing.

3. The connection of claim 2, wherein said retaining screws are made of aluminum.

4. The connection of claim 1, wherein both of said housings are made of light metal.

5. The connection of claim 1, wherein said retaining screws each have a self-cutting thread.

6. The connection of claim 5, wherein each of said retaining screws has a threaded shank and a coating applied to said threaded shank made of a material harder than the material of said cylinder housing.

7. The connection of claim 1, said flanges having respective surfaces at said interfaces; one of said surfaces having an annularly extending slot formed therein; and, a liquid seal filling said slot.

8. The connection of claim 7, said slot having a cross section which expands in a direction toward said surface.

9. The connection of claim 8, said slot having a trapezoidal cross section.

10. A connection of a crankcase housing of a reciprocating-piston internal combustion engine with a cylinder housing, the connection comprising:

first and second housing flanges formed on said crankcase housing and said cylinder housing, respectively;

said crankcase housing and said cylinder housing being positioned so as to cause said first and second flanges to lie one atop the other thereby conjointly defining an interface;

at least one of said crankcase housing and said cylinder housing being made of a light metal;

a cured liquid seal disposed between said flanges at said interface and said seal adhering to said flanges after curing thereby imparting strength to said connection; and, a plurality of retaining screws made also of light metal and being arranged so as to tightly clamp said flanges together.

11. The connection of claim 10, wherein the material of said retaining screws has essentially the same thermal expansion characteristics as the light metal material of said one housing.

12. The connection of claim 11, wherein said cured liquid seal is on a silicone basis or is a modified silicone seal.

* * * * *